US007104759B2

(12) United States Patent
Tipton et al.

(10) Patent No.: US 7,104,759 B2
(45) Date of Patent: Sep. 12, 2006

(54) COMPRESSOR BLADE PLATFORM EXTENSION AND METHODS OF RETROFITTING BLADES OF DIFFERENT BLADE ANGLES

(75) Inventors: Thomas Robbins Tipton, Simpsonville, SC (US); Nicholas Francis Martin, Jr., Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 80 days.

(21) Appl. No.: 10/814,228

(22) Filed: Apr. 1, 2004

(65) Prior Publication Data

US 2005/0220624 A1 Oct. 6, 2005

(51) Int. Cl.
*F03B 3/12* (2006.01)

(52) U.S. Cl. ..... 416/219 R; 416/204 A; 416/248

(58) Field of Classification Search ..... 416/1, 416/215, 216, 219 R, 221, 204 A, 239, 248
See application file for complete search history.

(56) References Cited

U.S. PATENT DOCUMENTS

| | | | | |
|---|---|---|---|---|
| 4,682,935 | A | 7/1987 | Martin | |
| 5,123,813 | A | 6/1992 | Przytulski et al. | |
| 5,156,528 | A | 10/1992 | Bobo | |
| 5,536,143 | A | 7/1996 | Jacala et al. | |
| 5,573,377 | A | 11/1996 | Bond et al. | |
| 5,743,708 | A | 4/1998 | Cunha et al. | |
| 5,924,843 | A | 7/1999 | Staub et al. | |
| 6,019,580 | A * | 2/2000 | Barr et al. | 416/219 R |
| 6,033,185 | A | 3/2000 | Lammas et al. | |
| 6,095,750 | A | 8/2000 | Ross et al. | |
| 6,132,174 | A | 10/2000 | Staub et al. | |
| 6,183,202 | B1 * | 2/2001 | Ganshaw | 416/219 R |
| 6,190,131 | B1 | 2/2001 | Deallenbach | |
| 6,390,775 | B1 | 5/2002 | Paz | |
| 6,402,471 | B1 | 6/2002 | Demers et al. | |
| 6,419,753 | B1 | 7/2002 | Wheat et al. | |
| 6,457,942 | B1 | 10/2002 | Forrester | |
| 6,520,836 | B1 | 2/2003 | Dean et al. | |
| 6,945,754 | B1 * | 9/2005 | DiBella | 416/219 R |

OTHER PUBLICATIONS

U.S. Appl. No. 10/422,701, Gautreau et al Undercut Leading Edge for Compressor Blades and Related Method.
U.S. Appl. No 10/327,949, Gautreau et al Compressor Blade with Dovetail Slotted to Reduce Stress on the Airfoil Leading Edge.

* cited by examiner

*Primary Examiner*—Edward K. Look
*Assistant Examiner*—Dwayne J White
(74) *Attorney, Agent, or Firm*—Nixon & Vanderhye P.C.

(57) ABSTRACT

Blades of increased blade angle may be retrofitted onto existing compressor rotor wheels as replacement blades whereby higher performance and efficiency without replacing the rotor wheel may be achieved. The base attachments of replacement blades are provided with lateral extensions or flanges and the rim of the compressor wheel is provided with recesses straddling the grooves to accommodate the flanges. The leading edge of the replacement blade is positioned circumferentially for support only by the platform extension thereby limiting the mean and vibratory stresses in the leading edge of the airfoil and maximizing damage tolerance.

13 Claims, 2 Drawing Sheets

COMPRESSOR BLADE PLATFORM EXTENSION AND METHODS OF RETROFITTING BLADES OF DIFFERENT BLADE ANGLES

BACKGROUND OF THE INVENTION

The present invention relates to compressor blades and methods of replacing compressor blades with blades having a different blade angle and particularly relates to compressor blades having a platform with one or more side flanges forming an extension for supporting a leading edge of the blade. The present invention also relates to such blades in combination with a modified compressor wheel groove and methods of retrofitting blades having a different blade angle than the blade angle of the blades being replaced on the wheel.

With the ever present need for higher performance and efficiency for compressors, new and improved blade designs have evolved with increased blade angles. For example, the higher performing and more efficient airfoils may have a greater twist than prior compressor blade airfoils and thus have a greater circumferential extent between leading and trailing edges in a direction along the periphery of the compressor wheel. It will be appreciated that the compressor wheel has a rim with a plurality of circumferentially spaced grooves for receiving bases of the compressor blades. For example, the groove may extend axially or slightly off axis and may comprise a dovetail configuration having a pair of circumferentially spaced radially outwardly converging side walls for receiving a correspondingly configured base attachment of the compressor blade. The blades are typically characterized as axial entry or slightly off axis entry blades. The blade base attachment has a radially outwardly facing platform surface which lies flush with the rim of the rotor wheel when the blade is installed. These configurations of blades and wheel grooves limit replacement of the blades to substantially identical blades. Otherwise, the entire compressor rotor wheel would require replacement to accommodate the newer higher performing and more efficient airfoils.

In large gas turbines used for generating electricity, power companies regularly water wash the turbines as soon as any performance degradation is noticed. The water wash is sprayed into the turbine near the hub at the compressor end and the fluid is flung out into the flow path cleaning the blades. As a result of this water wash, water droplets impact the first stage compressor blades causing significant erosion along the leading edges of the airfoils and especially at the hub of the airfoils where the airfoils meet the platform. Performance degradation and potential for failure of the airfoils causing extensive rotor damage oftentimes result. Consequently, there is a need to replace compressor blades when the airfoils are damaged, e.g., eroded due to water washing and foreign object damage, and more generally to provide blades with increased blade angles relative to the blade angles of the blades extant in the compressor.

BRIEF DESCRIPTION OF THE INVENTION

In accordance with a preferred aspect of the present invention, there is provided a compressor blade having a platform extension along one or both of the pressure and suction sides of the blade airfoil to accommodate a different, e.g., increased blade angle, of the replacement blade without replacement of the compressor wheel. The base attachment for the blade has one or more circumferential extensions along one or both of the opposite sides of the base attachment forming one or more cantilevered flanges. The flange (s) form a continuation of the platform surface which lies in the gas path. The leading edge of the compressor blade airfoil is disposed over and supported by the platform extension or flange. Also by locating the leading edge of the airfoil over the flange, the mean stress caused by centrifugal force and the additive vibratory stress in the leading edge of the airfoil are minimized.

To accommodate the compressor blade of increased blade angle on the compressor wheel, the groove of the wheel is modified by providing one or more recesses along opposite sides of the grooved surface to receive or accommodate the one or more flanges. Thus the current blade attachment shape of the groove is retained over the majority of its radial extent while the recesses accommodate the flange(s) thereby enabling the flange(s) or extension(s) to lie flush with the rim of the wheel. Additionally, the leading edge of the replacement airfoil is moved circumferentially towards the pressure side so that the leading edge is only supported by a flange or extension. This limits the mechanical loading transferred through the leading edge of the airfoil. It also increases the airfoil damage tolerance to water wash induced erosion, water injected power augmentation induced erosion and foreign object damage. Damage tolerance is a function of the material's fracture toughness, geometry of the flaw, airfoil mean stress and vibratory stress. The platform extension or flange minimizes the mean and vibratory stress levels in the leading edge of the airfoil.

In accordance with another aspect of the present invention, the damaged or eroded compressor blades can be replaced with new blades having an increased blade angle and hence more efficient and higher performing blades can be retrofitted without replacing the compressor wheel. By forming recesses on opposite sides of the groove and flanges on opposite sides of the base attachment, the replacement blade is receivable in the wheel groove with the flanges engaging in the recesses. The platform surface on the blade lies flush with the rim of the wheel and form parts of the gas path.

In a preferred embodiment according to the present invention, there is provided a compressor blade; an airfoil having a leading edge, a base attachment and a platform between the airfoil and the base attachment, the base attachment having side faces between end faces, the end faces facing in opposite generally axial directions of the blade attachment; the platform having flanges projecting from opposite sides of the blade and cantilevered over at least portions of the side faces; the airfoil being carried by the platform with the leading edge overlying a portion of the cantilevered flange along one side of the blade.

In a further embodiment according to the present invention, there is provided a method of replacing a first compressor blade on a compressor wheel having a groove opening through a rim of the wheel with a second blade, wherein the first compressor blade has a first blade angle, comprising the steps of removing the first blade from the compressor wheel; forming a pair of recesses along a rim of the wheel and along respective opposite sides of the groove; providing the second compressor blade with a second blade angle different than the blade angle of the first blade, a platform having a pair of flanges extending along opposite sides of the second blade and an airfoil having a leading edge thereof overlying one of the flanges; and mounting the second blade on the compressor wheel with a base attachment of the second blade in the groove and the flanges in the recesses.

In a further embodiment according to the present invention, there is provided a method of replacing a first compressor blade on a compressor wheel having a groove opening through a rim of the wheel with a second blade, comprising the steps of removing the first blade from the compressor wheel; forming a pair of recesses along a rim of the wheel and along respective opposite sides of the groove; providing the second compressor blade with a base attachment, a platform having a pair of flanges cantilevered along opposite sides of the second blade over the base attachment and an airfoil having a leading edge thereof overlying one of the cantilevered flanges; and mounting the second blade on the compressor wheel with the base attachment of the second blade in the groove and the flanges in the recesses.

DETAILED DESCRIPTION OF THE INVENTION

Figure 1:
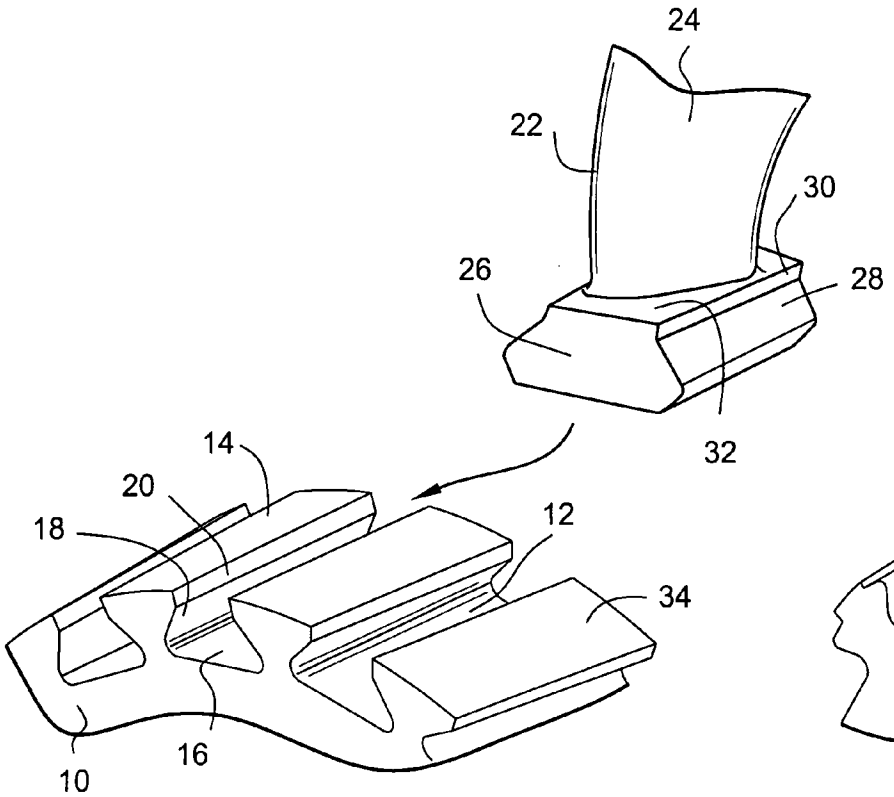
Fig.1 (PRIOR ART)
FIG. 1 is a fragmentary perspective view of a compressor wheel rim and a conventional compressor blade for disposition in one of the grooves of the rim.

Referring now to the drawings, particularly to FIG. 1 there is illustrated a compressor wheel 10 having a plurality of circumferentially spaced grooves 12 through the rim 14 of the wheel 10. The grooves 12 are generally oriented in an axial direction although it will be appreciated that a slight off axis or canted groove may be provided depending upon the compressor wheel and blade design. The groove 12 has a cross sectional configuration defined by a base 16 and opposed radially outwardly converging side walls 18 terminating in radial flats 20 adjacent the rim 14.

A plurality of compressor blades 22 are mounted on the wheel 10 at circumferentially spaced locations about the wheel. Each compressor blade 22 includes an airfoil 24 and a base attachment 26. The base attachment 26 has a cross sectional shape generally corresponding to the cross sectional shape of the groove 12. That is, the base attachment 26 includes opposite, radially outwardly converging inclined side walls 28 for general conformance with the side walls 18 of grooves 12 and flats 30 along the side faces of the blade 22. Thus the blade 22 may be disposed axially into the groove with the base attachment 26 residing in groove 12. It will be appreciated that, in the final position of the blade 22 on wheel 10, the platform surface 32 of the blade 22 lies flush with the surface 34 along rim 14 of wheel 10. The surfaces 32 and 34 in part define the gas path through the compressor.

When it becomes necessary to replace or retrofit new blades onto the rotor wheel 10, for example, to replace blades damaged as a result of water wash erosion or foreign objects impact or to increase the efficiency and performance of the compressor, replacement blades generally designated 40 may be installed on wheel 10 using the same mounting grooves 12 in wheel 10. Blade 40 may be a higher performing and more efficient airfoil 42 which, for example, may have a greater twist and hence a greater blade angle than the blade angle of blade 22. To accomplish, the blade 40 has an base attachment 44 which, similarly as blade 22, has radially outwardly converging side walls 46 generally corresponding to the shape of the side walls 18 of grooves 12. Instead of the flats along opposite sides of the blades 22 being replaced, the base attachment 44 has extensions 48 and 50 along opposite sides. The extensions 48 and 50 form cantilevered flanges projecting generally in opposite circumferential directions. Consequently the blade 40 includes a platform 52 having a wider platform surface 54 than the platform surface 32 of the blades 22 being replaced.

Figure 2:
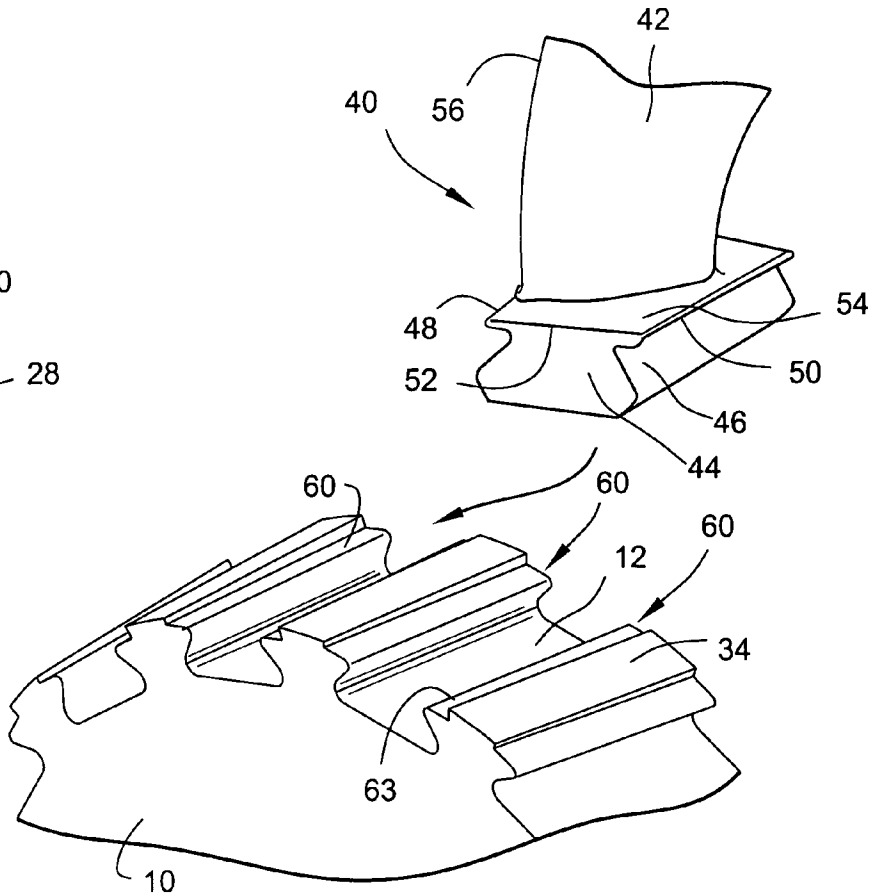
FIG. 2 is similar to FIG. 1 illustrating a compressor blade having a different blade angle poised for insertion in a modified compressor wheel groove.
Figure 4:
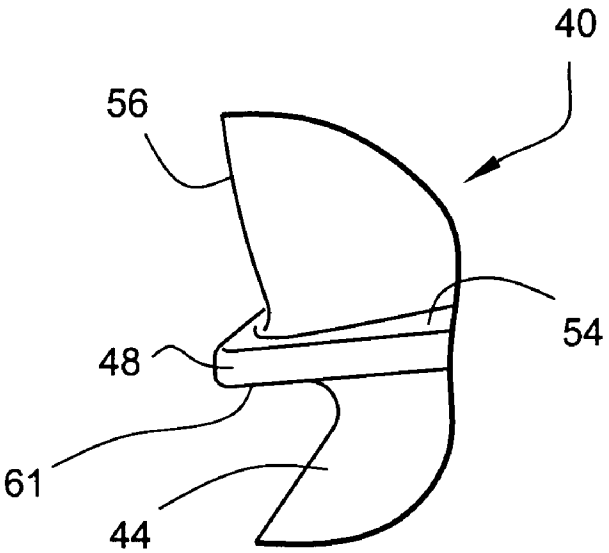
FIG. 4 is a fragmentary perspective view of the end of a compressor blade illustrating the leading edge overhang on the flange of the flange base attachment.

As best illustrated in FIGS. 2 and 4, the leading edge 56 of the blade 40 is displaced circumferentially towards the pressure side such that the leading edge is supported only by one extension or flange 48. Thus the mechanical loading transferred through the airfoil leading edge 56 is limited. This increases the damage tolerance of the airfoil to water wash induced erosion, water injected power augmentation induced erosion and foreign object damage. Mean and vibratory stress levels along the leading edge 56 of the airfoil 40 are also reduced by locating the leading edge overlying the flange 48.

Figure 3:
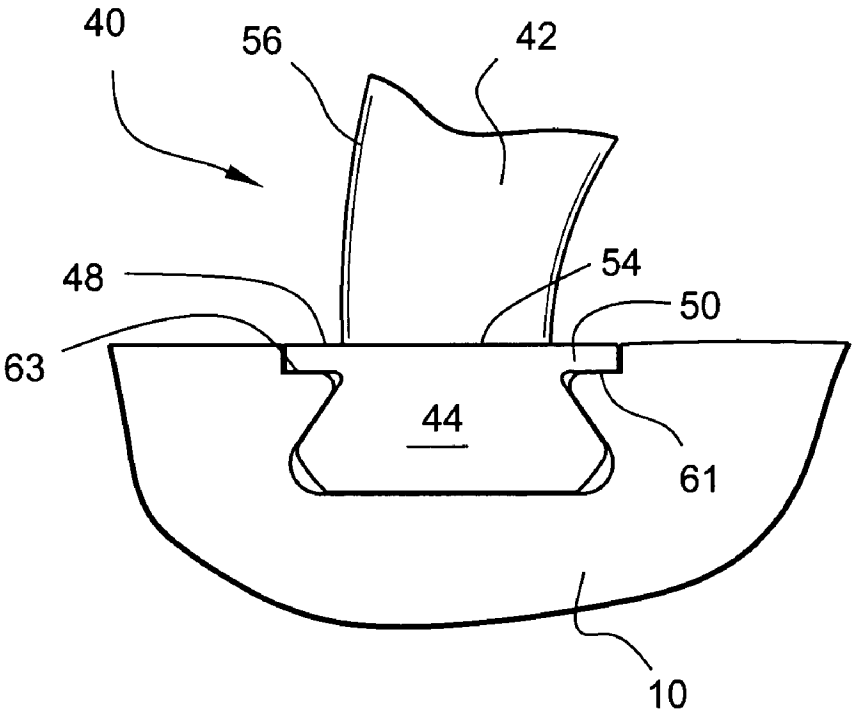
FIG. 3 is a fragmentary axial end view of the modified groove and blade attachment.

To mount the blade 40 on wheel 10, the grooves 12 of the wheel 10 are modified. Particularly, recesses 60 are formed in the surface 34 of rim 14 on opposite sides of the groove 12 to accommodate the flanges 48 and 50. The remaining portions of the groove 12 are not modified and receive the base attachment 44 of the blades 40. As illustrated in FIG. 3, the flanges 48 and 50 are disposed in the recesses 60, with an underside 61 of each flange seated on a shoulder 63 of the recess. The platform surface 54 of the replacement blade lies flush with the rim surface 34, both surfaces forming portions of the gas path.

As a consequence of the foregoing, compressor airfoils with blade angles that are different from the rotor wheel broach angle and which have higher performance and efficiency than blades provided an existing wheel may be retrofitted into existing compressor wheels without the need to replace the rotor wheel. Also, by locating the leading edge over the flange or extension and reducing the mean and vibratory stresses along the leading edge, damage tolerance to the blade is increased.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A compressor wheel mounting a plurality of compressor blades, each blade comprising;

an airfoil having a leading edge, a base attachment and a platform between the airfoil and the base attachment, the base attachment having side faces between end faces, said end faces facing in opposite generally axial directions of said blade attachment;

said platform having flanges projecting from opposite sides of the blade and cantilevered over at least portions of said side faces;

said airfoil being carried by said platform with said leading edge overlying a portion of said cantilevered flange along one side of said blade; the wheel including a generally axially extending groove having a cross sectional configuration corresponding generally to the cross sectional configuration of said base attachment for receiving and retaining the blade on the wheel, said groove having sidewalls and generally axially extending recesses along opposite sides of the groove for receiving the flanges of said blade; and wherein said wheel has an outer rim with said recesses being inset from said outer rim, and further wherein upon assembly, underside surfaces of said flanges are seated on shoulders of said recess, outer surfaces of said flanges lie substantially flush with the outer wheel rim, and said side faces of said base attachment are engaged with said side walls.

2. A compressor blade according to claim 1 wherein each of said side faces has discrete angled and linear walls extending in a generally axial direction.

3. A compressor blade according to claim 1 wherein said leading edge overlies the flange portion on a pressure side of the airfoil.

4. A method of replacing a first compressor blade on a compressor wheel having a groove opening through a rim of the wheel with a second blade, wherein the first compressor blade has a first blade angle, comprising the steps of:

removing said first blade from said compressor wheel;

forming a pair of recesses along a rim of the wheel and along respective opposite sides of the groove;

providing said second compressor blade with a second blade angle different than the blade angle of said first blade, a platform having a pair of flanges extending along opposite sides of said second blade and an airfoil having a leading edge thereof overlying one of said flanges; and mounting the second blade on the compressor wheel with a base attachment of said second blade in said groove and said flanges in said recesses.

5. A method according to claim 4 including forming the recesses to straddle the groove and with the recesses opening into the groove.

6. A method according to claim 4 including mounting the second blade in the groove with a radially outer surface of said platform lying flush with outer surfaces of the wheel rim.

7. A method according to claim 4 including mounting the second blade in the groove with a radially outer surface of said platform forming part of a gas path through the compressor.

8. A method according to claim 7 including forming the recesses to straddle the groove and with the recesses opening into the groove.

9. A method of replacing a first compressor blade on a compressor wheel having a groove opening through a rim of the wheel with a second blade, comprising the steps of:

removing said first blade from said compressor wheel;

forming a pair of recesses along a rim of the wheel and along respective opposite sides of the groove;

providing said second compressor blade with a base attachment, a platform having a pair of flanges cantilevered along opposite sides of said second blade over said base attachment and an airfoil having a leading edge thereof overlying one of said cantilevered flanges; and mounting the second blade on the compressor wheel with the base attachment of said second blade in said groove and said flanges in said recesses.

10. A method according to claim 9 including forming the recesses to straddle the groove and with the recesses opening into the groove.

11. A method according to claim 9 including mounting the second blade in the groove with a radially outer surface of said platform lying flush with outer surfaces of the wheel rim.

12. A method according to claim 9 including mounting the second blade in the groove with a radially outer surface of said platform forming part of a gas path through the compressor.

13. A method according to claim 12 including forming the recesses to straddle the groove and with the recesses opening into the groove.

* * * * *